United States Patent [19]

Frei

[11] Patent Number: 4,779,438

[45] Date of Patent: Oct. 25, 1988

[54] COIL SPRING MAKING MACHINE

[75] Inventor: Max Frei, Schönenwerd, Switzerland

[73] Assignee: Schenker Maschinen AG, Schönenwerd, Switzerland

[21] Appl. No.: 891,530

[22] Filed: Jul. 31, 1986

[30] Foreign Application Priority Data

Aug. 8, 1985 [CH] Switzerland ..... 03390/85

[51] Int. Cl.[4] ..... B21F 11/00

[52] U.S. Cl. ..... 72/131; 72/132

[58] Field of Search ..... 72/130, 131, 132, 135, 72/371; 83/321

[56] References Cited

U.S. PATENT DOCUMENTS

| | | | |
|---|---|---|---|
| 1,498,499 | 6/1924 | Wells | 83/321 |
| 2,119,002 | 5/1938 | Bergevin et al. | 72/132 |
| 2,902,079 | 9/1959 | Costello et al. | 72/131 |
| 4,528,831 | 7/1985 | Russell et al. | 72/131 |

FOREIGN PATENT DOCUMENTS 1267653 5/1968 Fed. Rep. of Germany .

*Primary Examiner*—E. Michael Combs

*Attorney, Agent, or Firm*—Peter K. Kontler

[57] ABSTRACT

A coil spring making machine wherein the advancing rolls for the wire are driven intermittently by a transmission which receives motion from a timing shaft through the medium of a reciprocable input element and two one-way clutches so simultaneously that the rolls rotate in opposite directions (one clockwise, the other counter clockwise). The knife which severs the wire at intervals so as to separate successive coil springs is driven by the timing shaft through the medium of a chain transmission and a link which causes the knife to travel along an endless circular path and to sever the wire while the advancing rolls are at, or close to, a standstill.

12 Claims, 1 Drawing Sheet

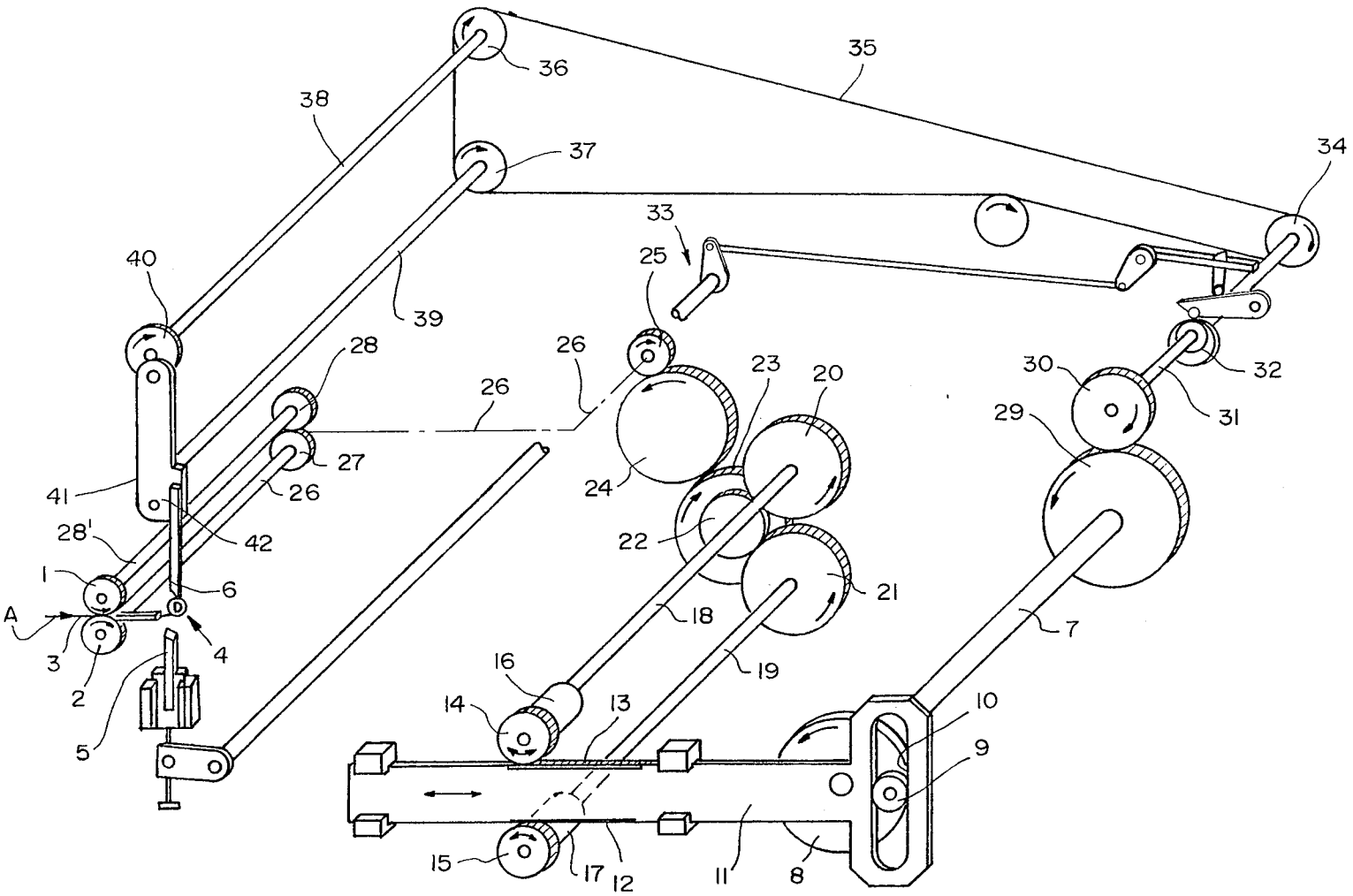
34
32
31
30
29
7
10
9
35
21
20
23
19
8
11
33
25
22
18
24
13
12
17
26
36
37
16
14
15
26
39
28
27
26
38
42
6
4
40
41
28'
1
3
2
5
A

COIL SPRING MAKING MACHINE

BACKGROUND OF THE INVENTION

The present invention relates to improvements in coil spring making machines of the type disclosed in commonly owned U.S. Pat. No. 4,509,352 granted Apr. 9, 1985.

In a conventional coil spring making machine the wire is fed continuously by two advancing rolls and is intermittently severed by a knife which is arranged to move along an endless path intersecting the path of forward movement of the wire. The making of such flying cut is believed to be desirable and advantageous in order to increase the output of the machine. The knife is driven by a specially designed clutch which performs one complete revolution in response to each engagement. Consequently, the timing of the severing operation depends upon the timing of engagement of the clutch. A drawback of conventional machines is that the clutch is subject to extensive wear as a result of repeated engagement and disengagement so that the output is limited by the maximum permissible frequency of engagement and disengagement of the clutch.

Another drawback of conventional machines is that the advancing rollers are driven at a constant speed and, when the machine is designed to turn out coil springs with flat end convolutions, the wire treating tool (particularly a pitch selector tool) must be set in motion with a pronounced acceleration. This, too, limits the output of conventional coil spring making machines.

German Pat. No. 1,267,653 discloses a modified coil spring making machine wherein the wire is advanced in stepwise fashion. The means for driving the advancing means comprises a reciprocable input element which is movable along a straight path and drives the advancing rolls through the medium of two discrete one-way clutches. The transmission between the input element and the advancing rolls further comprises a first number of torque transmitting elements which operate between one of the clutches and one of the advancing rolls, and a different second number of torque transmitting elements which operate between the input element and the other advancing roll. The torque transmitting elements comprise gears and the arrangement is such that a first number of gears is interposed between the first clutch and the advancing rolls but a different second number of gears is interposed between the second clutch and the advancing rolls. One of the two sets of torque transmitting elements further comprises a reversing gear which ensures that the advancing rolls are driven in a direction to move the wire forwardly regardless of the direction of reciprocatory movement of the input element of the transmission.

A drawback of the machine which is disclosed in the German patent is that the play between the gears of the two sets of torque transmitting elements is compounded which reduces the degree of accuracy with which the wire is advanced toward the severing and pitch selecting tools. In other words, the overall or combined play between the elements of the first set of torque transmitting elements is different from the combined play between the elements of the second set of torque transmitting elements. This entails the making of coil springs having different dimensions.

Another drawback of the machine which is disclosed in the German patent is that severing of the wire takes place upon completion of the coiling or winding operation not unlike in a stamping machine. The cut must be made in one of several dead-center positions of the driving elemeent. The output of such machines cannot be increased beyond a predetermined (relatively low) value.

OBJECTS AND SUMMARY OF THE INVENTION

An object of the invention is to provide a coil spring making machine whose output is higher than the output of conventional coil spring making machines.

Another object of the invention is to provide the coil spring making machine with novel and improved means for transmitting motion from the prime mover to the advancing rolls of the wire feeding mechanism.

A further object of the invention is to provide a coil spring making machine wherein the operation of the knife which severs the wire is synchronized with the operation of the wire treating tool or tools in a novel and improved way.

Still another object of the invention is to provide a novel and improved method of converting successive increments of an intermittently fed wire into a succession of discrete coil springs.

A further object of the invention is to provide a novel and improved motion transmitting connection between a timing shaft and the wire advancing rolls of the coil spring making machine.

The invention is embodied in a machine for converting wire into a succession of coil springs. The machine comprises feeding means which is operative to advance the wire along a predetermined first path, a wire treating tool which is mounted for movement with reference to the first path, a prime mover, a transmission which is interposed between the prime mover and the feeding means and serves to drive the feeding means cyclically so that the speed of the feeding means is repeatedly reduced to, or is close to, zero speed, a mobile knife for cyclically severing the wire to separate successive coil springs therefrom, guide means which serves to confine the knife to movements along a predetermined second path which intersects the first path, and drive means which is operative to move the knife along the second path so that the knife severs the wire at the intersection of the first and second paths while the speed of the feeding means equals or approximates zero.

The prime mover preferably comprises a rotary timing shaft, and the machine further comprises means for transmitting motion from the shaft to the treating tool.

The feeding means preferably comprises advancing rolls which rotate in opposite directions, and the transmission means preferably comprises a reciprocable input element which is driven by the prime mover, and first and second one-way clutches which are interposed between the input element and the respective advancing rolls.

The input element preferably comprises a rack having at least one row of teeth, and the transmission of such machine preferably further comprises first and second rotary gears (for example, a pair of pinions) which mate with the teeth and serve to drive the respective clutches. One of the clutches serves to drive the rollers while the input element moves in one direction, and the other clutch serves to rotate the rollers while the input element moves in the opposite direction.

In accordance with a presently preferred embodiment, the transmission further comprises a predetermined number of first torque transmitting elements which are interposed between the first clutch and the rollers and the same number of second torque transmitting elements which are interposed between the second clutch and the rollers. Such torque transmittng elements preferably include gears. At least one element of the first torque transmitting elements preferably constitutes an element of the second torque transmitting elements.

The input element is preferably reciprocable between two end positions, and the knife of the severing means is preferably arranged to sever the wire while the input element assumes or is close to one of the two end positions.

The second path is or can be an endless circular path, and the guide means can comprise a belt or chain transmission.

The knife and the wire treating tool are preferably located at opposite sides of the first path. The transmission can include a crank drive which is interposed between the timing shaft and the aforementioned reciprocable member. The drive means can comprise means (for example, a chain transmission) for continuously moving the knife along the second path.

The novel features which are considered as characteristics of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is a diagrammatic perspective view of a portion of a coil spring making machine which embodies the present invention.

DESCRIPTION OF THE PREFERRED EMBODIMENTS

The drawing shows a coil spring making machine which comprises two advancing rolls 1,2 together constituting a feeding mechanism which advances a continuous length of wire 3 in a predetermined direction as indicated by the arrow A. The directions in which the advancing rolls 1 and 2 are rotated are indicated by arrows. The wire 3 is drawn from a barrel or another suitable source, not shown.

The rolls 1, 2 advance the wire 3 stepwise to a coiling station 4 where the wire is treated by a wire treating tool 5, for example, a pitch selector tool of the type disclosed in the aforementioned U.S. Pat. No. 4,509,352.

The machine further comprises a prime mover including a continuously driven synchronizing or timing shaft 7 which receives torque from an electric motor or the like (not shown) and drives the advancing rolls 1, 2 through the medium of a novel transmission including the elements 8–28'. The transmission includes a disc-shaped crank arm 8 which is rigidly connected to the timing shaft 7 and carries an eccentric crank pin 9 extending into a vertical slot of a reciprocable input element 10 including an elongated straight toothed rack 11 having a first row of gear teeth 12 and a second row of teeth 13.

The teeth 12 of the lower row of teeth on the rack 11 mate with the teeth of a gear or pinion 15 which constitutes the input element of a first one-way clutch 17, and the teeth or the row of teeth 13 mate with the teeth of a gear or pinion 14 which constitutes the input element of a second one-way clutch 16. The output element of the clutch 16 drives a shaft 18 which carries a gear 20 in mesh with an intermediate gear 22. The one-way clutch 17 drives a shaft 19 which is rigid with a gear 21 also meshing with the intermediate gear 22. The gear 22 constitutes one component of a gear cluster which further includes a gear 23 meshing with a gear 24 which, in turn, drives a gear 25 on a shaft 26 for the advancing roll 2. The shaft 26 carries a gear 27 mating with a gear 28 on the shaft 28' of the advancing roll 1. It will be noted that the number of torque transmititng elements between the one-way clutch 16 and the shaft 26 equals the number of torque transmitting elements between the one-way clutch 17 and the shaft 26. Furthermore, several torque transmitting elements which are interposed between the clutch 16 and the shaft 26 constitute the elements of the torque transmitting means between the one-way clutch 17 and the shaft 26.

The timing shaft 7 further carries a larger gear 29 which drives a smaller gear 30 at a ratio of 2:1. The gear 30 is mounted on a shaft 31 serving to transmit motion to drive means for a guide member in the form of a link 42 carrying a severing device including a knife 6. The knife 6 is compelled to circulate along an endless circular path. The drive means comprises a sprocket wheel 34 which is mounted on the shaft 31, an endless chain 35 which is trained over the sprocket wheel 34, and two additional sprocket wheels 36, 37, two shafts 38, 39 which are respectively driven by the sprocket wheels 36, 37 in directions indicated by the arrows, and disc-shaped crank arms 40, 41 which are respectively mounted on the shafts 38, 39 and have eccentric crank pins connected to the upper and lower portions of the guide means 42, respectively.

A disc-shaped cam 32 carried by the shaft 31 drives a linkage 33 which transmits motion to the wire treating tool 5 in synchronism with intermittent rotation of the advancing rolls 1, 2 and with continuous orbital movements of the knife 6.

The construction of the improved machine is such that the knife 6 severs the wire 3 when the input element 10 assumes the one or the other end position. In other words, the wire 3 is severed at a time when the speed of the advancing rolls 1, 2 is zero or close to zero.

An important advantage of the improved machine is that it can turn out a large number of coil springs per unit of time in spite of the fact that the wire 3 is advanced in stepwise fashion. This is attributed to the fact that the knife 6 is caused to circulate continuously along an endless path which intersects the path of forward movement of the wire 3 and that intermittent angular movements of the advancing rolls 1, 2 (constituting the feedimg means of the improved machine) are properly synchronized with movements of the wire treating tool 5 and knife 6. The length of successively severed sections of the wire 3 invariably matches a predetermined value because the wire is severed at a time when the input element 10 of the transmission between the timing shaft 7 of the mover and the advancing rolls 1, 2 of the wire feeding means assumes the one or the other end position, namely when the advancing rolls 1, 2 are at a standstill or are close to a standstill.

The drawing shows suitable guide means which confine the toothed rack 11 of the transmission between the shaft 7 and the rolls 1, 2 to movement along a straight path. The one-way clutch 16 transmits torque to the shaft 18 when the one-way clutch 17 cannot transmit torque to the shaft 19 and vice versa.

An important advantage of the improved machine is that a complete coil spring can be produced during each half of a complete machine cycle. Furthermore, eventual play between the gears which transmit torque from the clutch 16 to the rolls 1 and 2 and the gears which transmit torque from the clutch 17 to the rolls 1 and 2 does not affect the accuracy of the coil making operation because the number of torque transmittng elements between the clutches 16 and 17 and the shaft 26 are equal. In other words, eventual play between the torque transmitting elements whch are interposed between the clutches 16, 17 on the one hand and the shaft 26 on the other hand cannot unduly influence the accuracy of the coil spring making operation.

It can be said that the curve denoting the speed at which the wire 3 is advanced along the path indicated by the arrow A resembles a sine wave. The speed of the advancing rolls 1, 2 is zero or close to zero whenever the path along which the cutting edge of the knife 6 moves intersects the path which is indicated by the arrow A. This renders it possible to orbit the cutting edge of the knife 6 at a relatively low speed. Such mode of driving the cutting edge of the knife 6 is highly desirable, especially since the drive smeans for the knife 6 does not have to embody a one-revolution clutch which is required in conventional coil spring making machines.

When the machine is designed to form coil springs with closely adjacent or flat end convolutions, the treating or pitch selector tool 5 is required to perform a movement at the start and toward the end of each stepwise advance of the wire 3. Since the speed of movement of the treating tool 5 is proportional to the speed of forward movement of the wire 3, the speed of the treating tool 5 in the improved machine is relatively low which is desirable, especially if the machine is to turn out a large number of coil springs per unit of time. Suitable free wheel clutches 16, 17 are of the type FK 17 and available from Fa. Ringspann, Bad Homburg, Federal Republic of Germany.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meansing and range of equivalence of the appended claims.

I claim:

1. A machine for converting wire into a succession of coil springs, comprising feeding means operative to advance the wire along a predetermined first path; a wire treating tool mounted for movement with reference to said path; a prime mover; a transmission interposed between said prime mover and said feeding means to drive said feeding means cyclically so that the speed of said feeding means is repeatedly reduced from a maximum speed to, or close to, zero speed; a mobile knife for cyclically severing the wire to separate successive coil springs therefrom; guide means arranged to confine the knife to movements along a predetermined second path which intersects said first path, said second path being an endless circular path; and drive means operative to move the knife around the entire second path in a single direction at a relatively low speed with respect to said maximum speed of said feeding means and so that the knife severs the wire at the intersection of said first and second paths while the speed of the feeding means equals or approximates zero.

2. The machine of claim 1, wherein said prime mover comprises a rotary timing shaft; and further comprising means for transmitting motion from said shaft to said treating tool.

3. The machine of claim 1, wherein said feeding means comprises advancing rolls arranged to rotate in opposite directions and said transmission comprises a reciprocable input element driven by said prime mover and first and second one-way clutches interposed between said input element and the advancing rolls.

4. The machine of claim 3, wherein said input element comprises a rack having at least one row of teeth and said transmission further comprises first and second rotary gears mating with said teeth and arranged to drive the respective clutches, one of said clutches being arranged to drive the rolls while said input element moves in one direction and the other of said clutches being arranged to rotate the rolls while said input element moves in the opposite direction.

5. The machine of claim 3, wherein said transmission further comprises a predetermined number of first torque transmitting elements interposed between said first clutch and one of said rolls, and the same number of second torque transmitting elements interposed between said second clutch and the same are of said one roll.

6. The machine of claim 5, wherein said torque transmitting elements include gears.

7. The machine of claim 5, wherein at least one element of said first torque transmitting elements constitutes an element of said second torque transmitting elements.

8. The machine of claim 3, wherein said input element is reciprocable between two end positions and said knife is arranged to sever the wire while said input element assumes or is close to one of said end positions.

9. The machine of claim 1, wherein said drive means comprises a belt or chain transmission.

10. The machine of claim 1, wherein said knife and said tool are located at opposite sides of said first path.

11. The machine of claim 1, wherein said transmission includes a crank drive.

12. The machine of claim 1, wherein said drive means comprises means for continuously moving the knife along said second path.

* * * * *